United States Patent [19]

Cronin

[11] 4,169,965

[45] Oct. 2, 1979

[54] INTEGRALLY COOLED ELECTRICAL FEEDTHROUGH BUSHING

[75] Inventor: Edward F. Cronin, Lenox, Mass.

[73] Assignee: General Electric Company

[21] Appl. No.: 879,052

[22] Filed: Feb. 21, 1978

[51] Int. Cl.[2] ..... H01B 17/26; H01B 17/28; H01F 27/12

[52] U.S. Cl. ..... 174/15 BH; 174/31 R; 174/143

[58] Field of Search ..... 174/11 R, 11 BH, 12 BH, 174/14 BH, 15 R, 15 BH, 16 BH, 18, 17 SF, 31 R, 143, 21 C

[56] References Cited

U.S. PATENT DOCUMENTS

| | | | |
|---|---|---|---|
| 3,626,079 | 12/1971 | Keen, Jr. et al. | 174/15 BH |
| 4,132,853 | 1/1979 | Wagenaar | 174/15 BH |

FOREIGN PATENT DOCUMENTS

| | | | |
|---|---|---|---|
| 17402 | of 1890 | United Kingdom | 174/21 C |

*Primary Examiner*—Laramie E. Askin

*Attorney, Agent, or Firm*—Francis X. Doyle; Richard A. Menelly

[57] ABSTRACT

An electrical feed through bushing for transformers multifunctionally uses the transformer coolant to cool the bushing conductor. The bushing is piped into the transformer oil heat exchanger.

5 Claims, 6 Drawing Figures

14
12
11
16
31
21
15
10
17
23
22
19

14
11
26
10
21
31
16
21
15
21
17
22
19

INTEGRALLY COOLED ELECTRICAL FEEDTHROUGH BUSHING

BACKGROUND OF THE INVENTION

This invention relates to electrical bushings of the type consisting of a porcelain housing concentrically arranged about a continuous metal feedthrough conductor. The porcelain envelope prevents electrical discharges from occurring between the electrical conductor and the transformer casing when the bushing is mounted into the casing.

In order to prevent the bushing from becoming overheated when large currents are being transmitted to and from the transformer, the porcelain housing generally contains a filling of insulating oil as a liquid coolant. The natural convection of the oil within the sealed bushing unit keeps the bushing from overheating. The oil efficiently carries heat from the hotter regions of the bushing to the cooler regions in a continuous convection process.

When very high voltages and currents are to be carried by oil filled bushings, it is necessary to provide a conductor of substantial size to ensure sufficient cooling or to connect a plurality of bushings in an electrical parallel relationship. In some applications an aperture is provided within the bottom portion of the bushing that is in contact with the transformer oil. The oil from the transformer itself is then caused to circulate up through the bushing in order to insulate and cool the bushing conductor. U.S. Pat. No. 3,626,079 issued on Dec. 7, 1971 discloses an electrical bushing using the transformer cooling oil to cool the bushing conductor.

An alternative method for cooling high power bushings is to provide a separate heat exchanger and pump arrangement for circulating oil through the bushing for cooling purposes. U.S. Pat. No. 1,983,371 issued Dec. 4, 1934 discloses a high temperature bushing having a separate heat exchanger for cooling the bushing oil.

With the recent government restrictions on the nature of transformer cooling oil, the price of acceptable oil can be prohibitive in large size power transformers. The use of a plurality of large oil filled bushings further adds to the total quantity of oil and further increases the overall economics of the system. The purpose of this invention is to provide an electrical bushing for high power transformers with a minimum of transformer oil and with optimum bushing cooling efficiency.

SUMMARY OF THE INVENTION

An electrical bushing for high power transformers becomes integrally cooled by sharing the transformer coolant in a prearranged forced thermal cycle. When the transformer comprises an oil filled transformer having an auxiliary heat exchanger, the cooled transformer oil is first pumped through the bushing to cool the bushing before entering the transformer. When the transformer is a vaporization cooled transformer, the condensed coolant is first caused to transfer through the bushing before returning to the transformer.

In one embodiment, the bushing includes an outer porcelain jacket surrounding the bushing's porcelain casing to contain the coolant. Another embodiment includes the use of a spacing device to direct the coolant along the bushing conductor to substantially reduce the quantity of coolant employed.

DESCRIPTION OF THE PREFERRED EMBODIMENT

Figure 1:
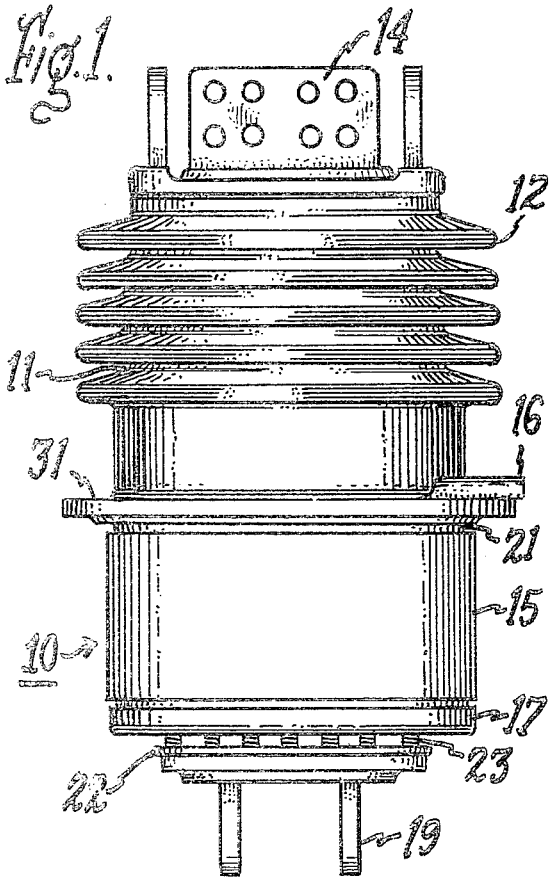
FIG. 1 is a front view of the integally cooled bushing according to the invention.

FIG. 1 shows an integally cooled bushing 10 having a porcelain housing 11 with a plurality of circumferential projections 12 to prevent arcover from occurring between terminal 14 and ground metal support when the bushing 10 is mounted into a transformer casing.

A continuous electrical connection is provided between top terminal 14 and bottom terminal 19 since both terminals are connected with a continuous single piece of metal conductor. An outer porcelain jacket 15 is provided around the porcelain housing 11 to contain and control the flow of transformer coolant fluid within bushing 10 in a manner to be described in detail below. The transformer coolant is caused to enter bushing 10 by means of a fitting 16 and the jacket 15 is sealed to the mounting flange 31 by means of gasket 21. The entire bushing assembly is held together under spring tension by means of conductor 26 connecting top terminal 14 and bottom terminal 19. In order to show the relationship between the porcelain jacket 15 and terminals 14 and 19 reference is now made to FIG. 2.

Figure 2:
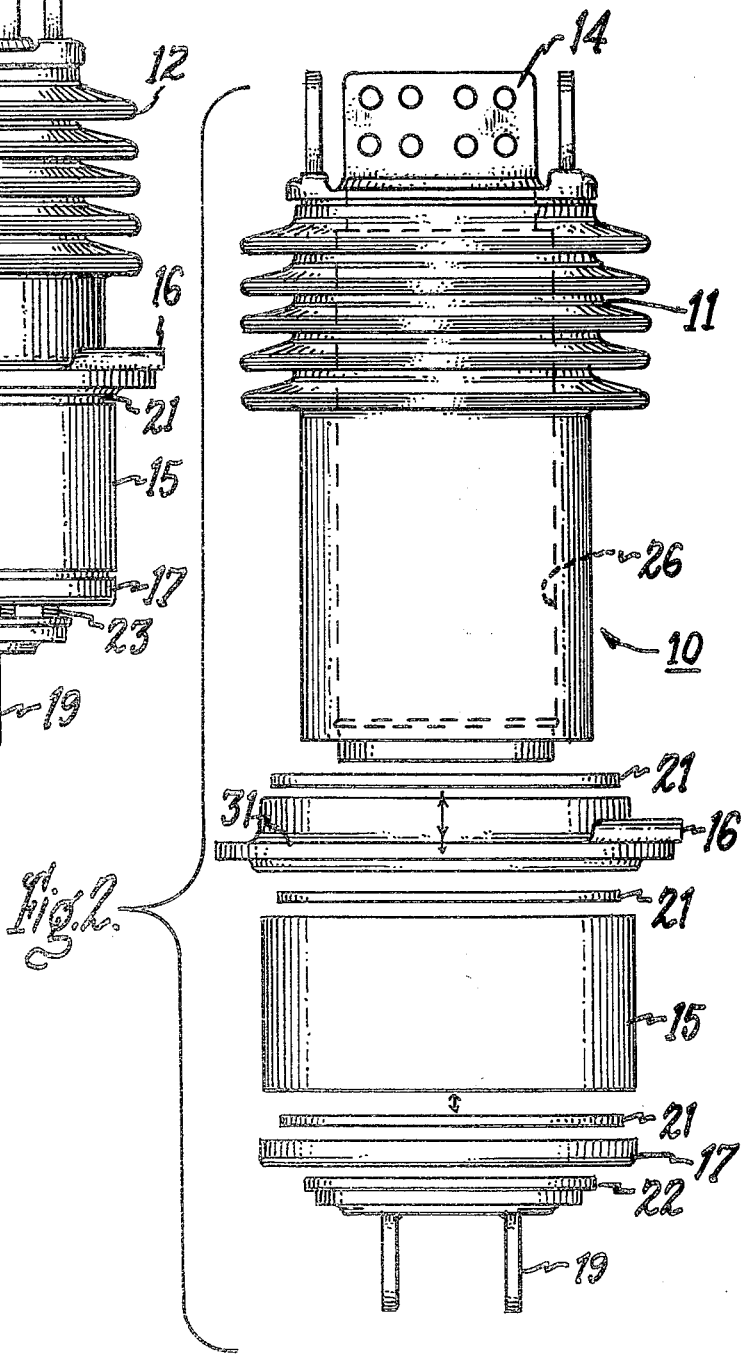
FIG. 2 is an exploded front view of the bushing of FIG. 1.
Figure 3:
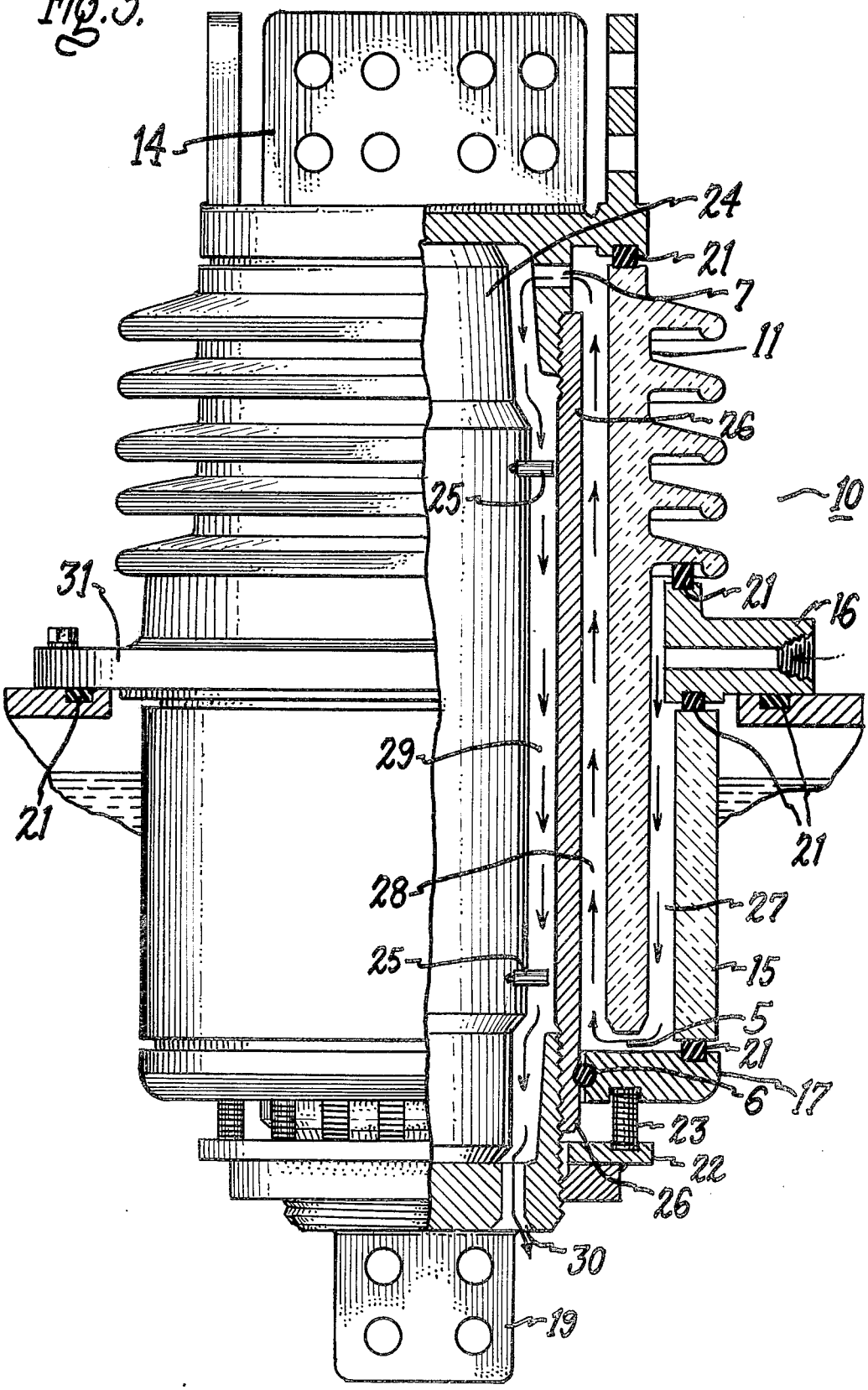
FIG. 3 is a sectional view of the embodiment of FIG. 1.

FIG. 2 shows the bushing components before being fitted in the configuration denoted earlier in FIG. 1. The porcelain casing 11 is sealably attached to the top terminal 14 and is fitted with a circumferential gasket 21 which seats on the uppermost end surface of casing 11 and which serves to seal the porcelain casing 11. The pipe fitting 16 is carried by the support 31 and provides convenient means for transmitting oil to the space formed between the porcelain outer jacket 15 and casing 11. Although other means for providing the external porcelain housing 15 are readily apparent, the embodiment of FIG. 2 is readily adaptable with currently manufactured casings 11 so that little changes are required to provide the advantages of the invention. FIG. 3 is a detailed sectional view of the assembled embodiment of FIG. 1 and like reference numerals will be employed where possible. Porcelain casing 11 is sealed by a gasket 21 to top electrode 14 and to pipe fitting 16 to support 31 by a pair of gaskets 21, one of which also serves to seal the outer porcelain jacket 15 at one end and the other end of jacket 15 is sealed by a gasket 21 to bottom washer 17.

In order to provide sufficient tension during initial installation, and to accommodate for variations in the thermal expansions and contractions of conductor 26, a plurality of springs 23 are inserted between bottom washers 17 and 22.

A cylindrical metal conductor or conduit 26 provides electrical connection between top terminal 14 and bottom terminal 19. The electrically conductive conduit 26 is attached to top electrode 14 by means of a threaded insertion on conductor 26 and complementary threaded portion on the end of electrode 14. Bottom electrode 19 also contains a threaded portion for connecting with oppositely threaded end of conduit 26. The threaded arrangement at both ends of conduit 26 serves to hold the entire bushing assembly 10 and to provide the necessary compression to the jacket 15 and sealing gaskets 21. The concentric arrangement between outer jacket 15 and casing 11 provides a channel 27 for the circulation of coolant. A second channel 28 is provided between the electrical conductor 26 and casing 11 for the transfer of coolant along conductor 26; and access between channel 27 and channel 28 is provided by means of opening 5. A third channel 29 is provided by the insertion of a fluid displacement means 24 which serves to fill the major portion of the volume assigned within the electrical conductor 26. The displacement means 24 provides an important feature to the bushing arrangement of the invention. The presence of the displacement means 24 serves not only to force the coolant flow into close proximity with electrical conductor 26 but also to displace the volume within bushing 10 which would otherwise be filled with costly oil. The displacement means 24 can consist of a cylinder of either electrically conductive or electrically insulating material. An ideal configuration for providing displacement means 24 could be an aluminum cylinder. The aluminum material would provide heat sink facilities to the bushing 10 in conditions of transformer overload and would serve to redistribute the heat away from the vicinity of electrical conduit 26 which is the main source of heat within bushing 10. A plurality of spacing dowels 25 are provided around the perimeter of the spacing means 24 in order to provide the proper dimensions to the third channel 29 depending on the thermal load requirements of bushing 10. Access between the second cooling channel 28 and the third channel 29 is provided by means of an aperture 7 through top terminal 14 or a plurality of perforations. An exhaust opening 30 is provided through bottom terminal 19 to transport the oil to the transformer when bushing 10 is inserted into a transformer and fastened to the transformer by means of a flange 31. Points of contact existing between the porcelain and metal parts can be sealed by means of "O" ring gaskets 6 where the bottom terminal 19 meets the electrical conductor 26. It is to be noted that dowels 25 can be made of electrically conducting or electrically insulating materials.

Figure 4:
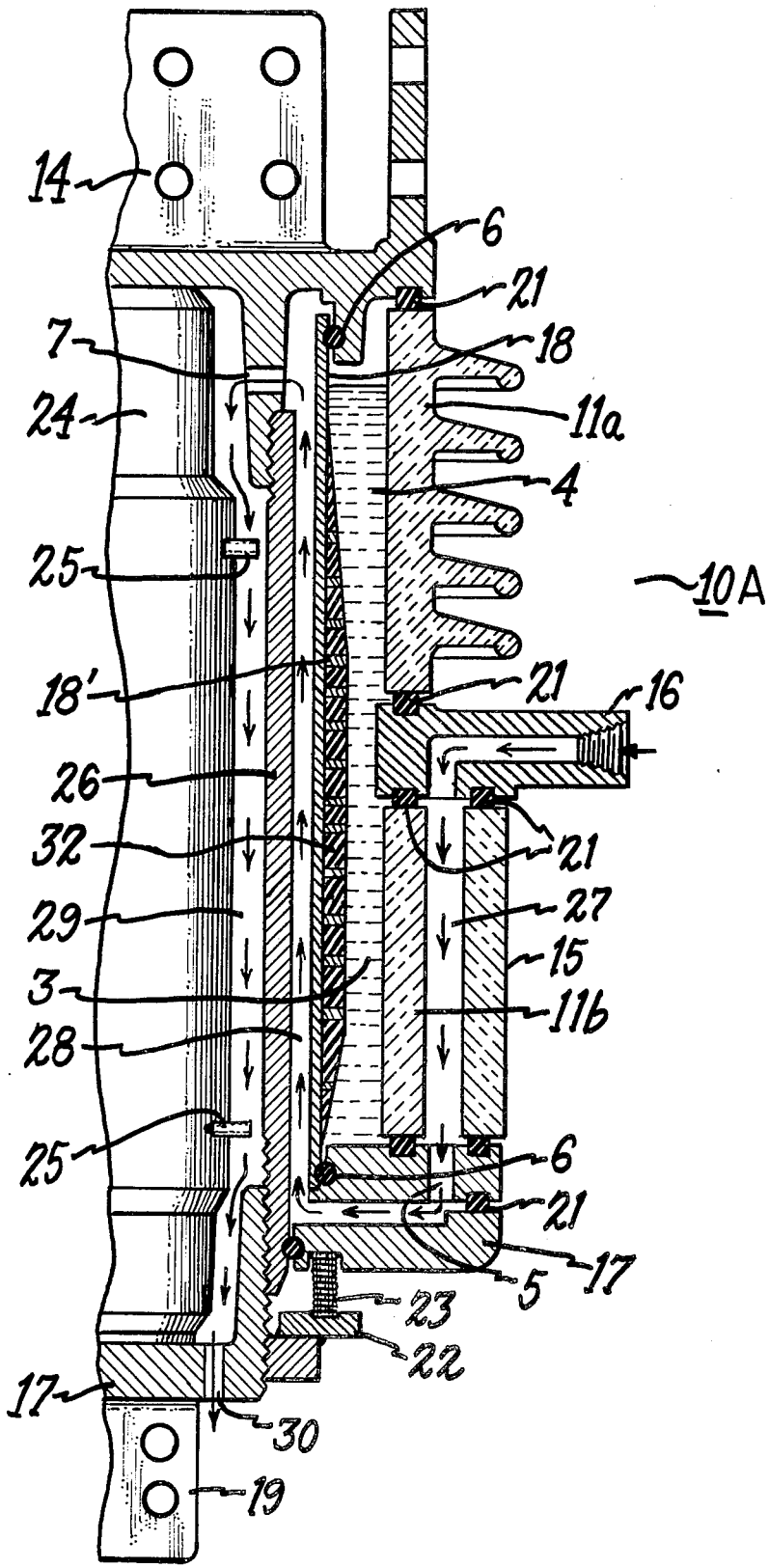
FIG. 4 is a sectional view of a further embodiment of the integral cooled bushing according to the invention.

FIG. 4 is a further embodiment of an electrical bushing 10A according to the invention. In the embodiment of FIG. 4 the casing 11 is divided into two portions such as a top portion **11*a* and a bottom portion 11*b*. The pipe fitting 16 is connected between the top and bottom portions of the casing 11*a*, 11*b* by means of a pair of gaskets 21. The advantage of the embodiment of FIG. 4 is the use of a conductor or conduit 18 with a layer of graded stress insulation material 32 having a plurality of conductive stripes 18'. The combination of the conductor 18 and insulation 32 provides capacitance coupling between the electrical conductors and grounded flange 31. The capacitance coupling provides low radio involvement voltage to the bushing 10A for reducing radio frequency noise generation. A displacement means 24 is employed in combination with dowels 25 for the same purpose as described earlier for the embodiment of FIG. 3. Also included are the third channel 29, second channel 28, and first channel 27 for the purposes as described earlier. A new channel 3 is formed between the casing 11*b* and 11*a* and the electrical conduit 18 for the purpose of retaining a quantity of bushing insulating oil 4. The bushing insulating oil 4 remains stationary whereas the forced transformer oil follows the path indicated by arrows in a manner described earlier for the embodiment of FIG. 3 and exits into the transformer by means of exit opening 30. The combination of the bushing insulating oil and the stress controlled insulation material 32 provides the improved low radio involvement voltage properties whereas the circulating coolant serves to cool the electrode 26** as described earlier.

Figure 5:
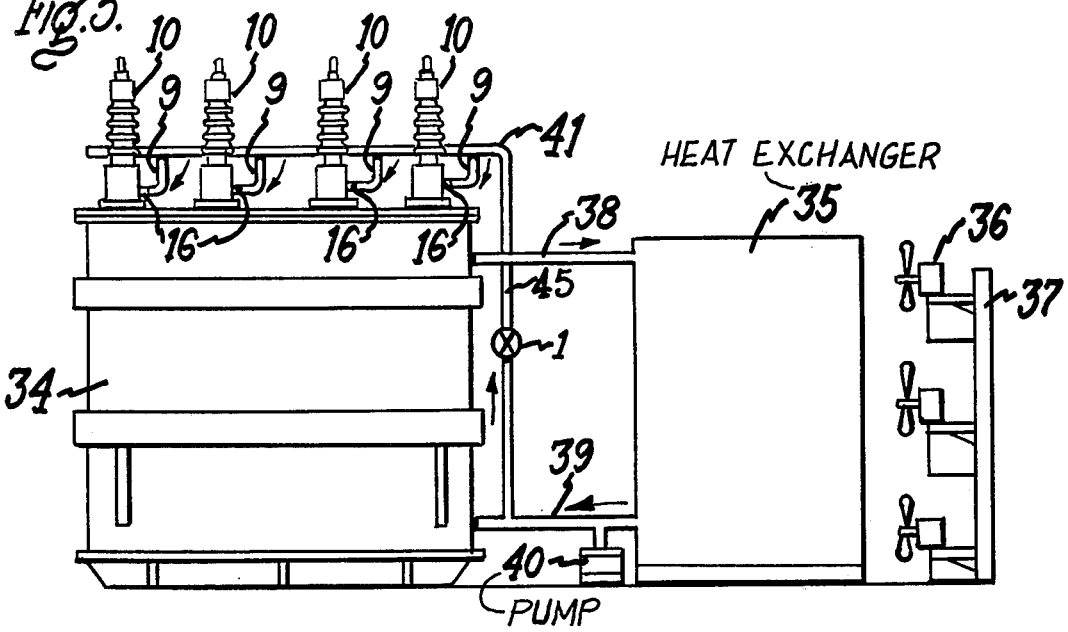
FIG. 5 is a side view of an auxiliary cooled oil transformer containing the integrally cooled bushing according to the invention.

An efficient integral cooling system using the integrally cooled electrical bushings 10 or 10A of the invention can be seen be referring now to FIG. 5. An oil filled transformer 34 contains a plurality of bushings 10 (or 10A) mounted on the top surface thereof by means of a plurality of corresponding flanges 31. Transformer 34 is of the forced cooled type that includes a heat exchanger 35 with a plurality of cooling fans 36 mounted on a suitable support frame 37. Transformer oil exits from the transformer 34 by means of an upper pipe 38 wherein it becomes circulated through the heat exchanger 35 and returned to the transformer 34 by means an oil circulation pump 40 via bottom pipe 39. The transformer cooling oil therefore is removed from the upper level of the transformer 34 at a particular temperature, is transported into heat exchanger 35 where cooling air removes a substantial quantity of the heat from the oil and returns to the bottom portion of the transformer 34 at a lower temperature. The integrally cooled bushings 10 (or 10A) share the heat exchanging mechanism employed for cooling the transformer oil in the following manner. A portion of the cooled transformer oil is caused to flow up vertical pipe 45 into a manifold 41. The manifold 41 has a plurality of connecting pipes 9 which are coupled with the pipe fittings 16 on each of the bushings 10 (or 10A). A portion of the cooled transformer oil is therefore caused to transmit through each of the bushings 10 (or 10A) and cools the bushing, conductors 26 and terminals 14 and 19 in the process. Since the quantity of oil transmitting through the bushings 10 is negligible relative to the total quantity of oil employed within transformer 34, the transformer oil becomes only slightly heated in the process of cooling the bushings 10 (or 10A). The flow rate of the transformer oil through the bushings 10 (or 10A) can be carefully adjusted by means of valve 1 to provide a sufficient flow rate depending upon the load conditions imposed upon transformer 34.

Figure 6:
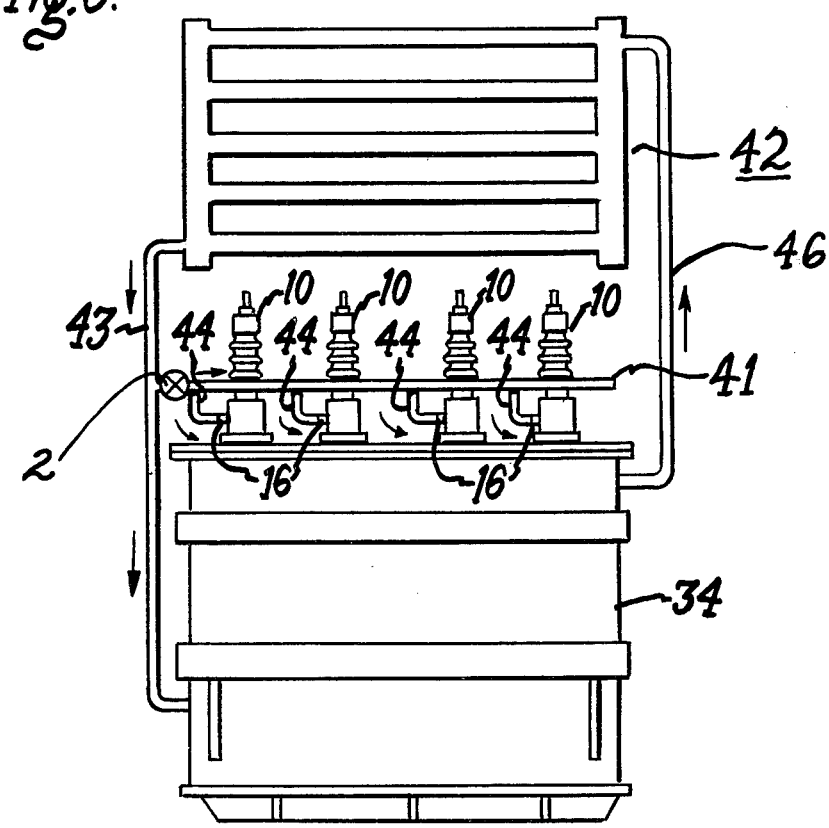
FIG. 6 is a side view of a vaporization cooled transformer containing the integrally cooled bushings of the invention.

A further application for using the integally cooled bushings 10 or 10A of the invention can be seen by referring to FIG. 6 which includes a vaporization cooled transformer 34. The coolant used within transformer 34 generally comprises a fluorinated hydrocarbon of the type currently employed within air conditioning units. Efficient vaporization cooled transformers are described in detail in U.S. Pat. application Ser. No. 847,067 filed Oct. 31, 1977 and U.S. Pat. application Ser. No. 843,676 filed Oct. 19, 1977. Vaporization cooled transformer 34 employs a heat exchanger 42 connected to transformer 34 by means of pipe 46 wherein the coolant condenses to give off its heat as heat of condensation and returns back to the transformer 34 by means of condensate return pipe 43. The bushings 10 (or 10A) mounted on the top surface of transformer 34 become cooled by a pipe manifold 41 connected to the condensate return 43 which is operatively coupled with the manifold 41 by means of valve 2. The condensed coolant enters bushings 10 (or 10A) by means of pipe fittings 16 and connecting pipes 44 as shown. The condensed coolant entering within bushing 10 (or 10A) absorbs heat from conductor 26 and exits through the bottom of the bushing 10 (or 10A) in a manner described for the embodiments of FIGS. 3 and 4.

The use of the integrally cooled bushing of the invention multi-functionally employs the coolant used with the transformer to also cool the conductor elements within the bushing. The efficient use of a common coolant for both bushings and transformer internal elements represents a substantial savings in transformer coolant and an increase in the overall transformer operating efficiency.

Although the integrally cooled electrical bushings of the invention are described for use with oil cooled and condensation cooled transformers, this is by way of example only. The integrally cooled bushings of the invention find application wherever bushings are employed and wherever bushings can also multifunctionally employ the coolant of the electrical apparatus involved.

I claim:

1. An electrical bushing cooling system in combination with an electrical apparatus of the type containing insulating fluid coolant and including a heat exchanger comprising in combination:

a plurality of integrally cooled electrical bushings connected with said electrical apparatus for providing electrical access to within said apparatus fluid coolant displacement means contained within each bushing for defining a fluid transfer path within each of said bushings; and piping means coupling between a return line from the heat exchanger and each bushing for delivering fluid coolant from the heat exchanger to each bushing.

2. The combination of claim 1 wherein each of the bushings includes an outlet connecting between the bushing and the electrical apparatus for returning the fluid coolant to the electrical apparatus.

3. The combination of claim 2 wherein the fluid coolant comprises a transformer oil.

4. The combination of claim 2 further including valve means between the heat exchanger and the bushings for regulating the control of fluid coolant from the heat exchanger to the bushings.

5. The combination of claim 1 wherein the fluid coolant comprises a vaporizable fluid.

* * * * *